United States Patent [19]

Moorehead

[11] 4,398,551

[45] Aug. 16, 1983

[54] HYDRAULIC SURFACE CLEANING APPARATUS

[75] Inventor: Robert M. Moorehead, Richardson, Tex.

[73] Assignee: Comar, Inc., Dallas, Tex.

[21] Appl. No.: 288,527

[22] Filed: Jul. 30, 1981

[51] Int. Cl.[3] ..... B08B 3/02

[52] U.S. Cl. ..... 134/104; 15/405; 134/111

[58] Field of Search ..... 134/104, 111, 105; 15/405

[56] References Cited

U.S. PATENT DOCUMENTS 759,141 5/1904 Thurman ..... 15/405

4,018,483 4/1977 Smith ..... 15/405

*Primary Examiner*—Robert L. Bleutge

[57] ABSTRACT

A beach or other surface cleaning method and apparatus is disclosed, wherein low density debris, particularly oil and tar residues, are removed for subsequent separation and disposal. The apparatus employs hydraulic principles to float the debris from the surface, propel the floated debris into a scoop, and lift the floated debris into a receiving trough for subsequent separation. Water employed to provide the hydraulic actions may be recirculated for continuous reuse.

9 Claims, 3 Drawing Figures

HYDRAULIC SURFACE CLEANING APPARATUS

This invention relates generally to surface cleaning apparatus and more particularly to an apparatus employing hydraulic principles to remove water buoyant debris from the surface of beaches and ice as encountered on lakes and on the ocean.

Over the years, oil spills on the oceans have caused environmental problems for beaches. Cleanup of spilled oil has been primitive, consisting primarily of costly and inefficient removal of beach surface material along with the oil, tar mats and tar balls which foul the beach surface. The attendant excessive loss of beach sand has been destructive of what has been long recognized as a valuable natural resource. Oftimes replacement beach sand must be hauled in to restore the desired aesthetic appearance and function of the beach for bathing purposes. Further attempts at coping with oil and tar spills that wash up on beach expanses have employed the futile method of raking the beach surface to merely "hide" the tar and oil. This approach is at best a highly temporary solution to the problem because subsequent wave and tide action on the beach inevitably causes the oil and tar mess to re-surface.

Accordingly an object of the present invention is to provide an improved mobile beach cleaning apparatus useful in removing tar and debris from sand beach surfaces, including beach surfaces that may comprise soil, ice per se, or iced-over terrain.

A further object of the present invention is to provide an improved beach cleanup apparatus useful in removing oil and tar spills in a cost-effective manner with minimal loss of beach sand.

The present invention is featured in the employment of hydraulic principles to float debris such as oil and tar and propel the lifted debris into a scoop, with subsequent disposal of the oil and tar material from the debris in the scoop.

A further feature of the invention is the employment of hydraulic principles to float water buoyant surface material and propel same to a receiving container in a manner employing the principles of fluids which avoids problems associated with mechanical pick-up devices.

A still further feature of the present invention is the provision of a hydraulic beach cleaning apparatus wherein water employed in debris lifting and propelling operations is recirculated, with water lost in the process being provided by a make-up water supply in a substantially closed-loop system, thus permitted high mobility and efficiency of the apparatus.

Figure 1:
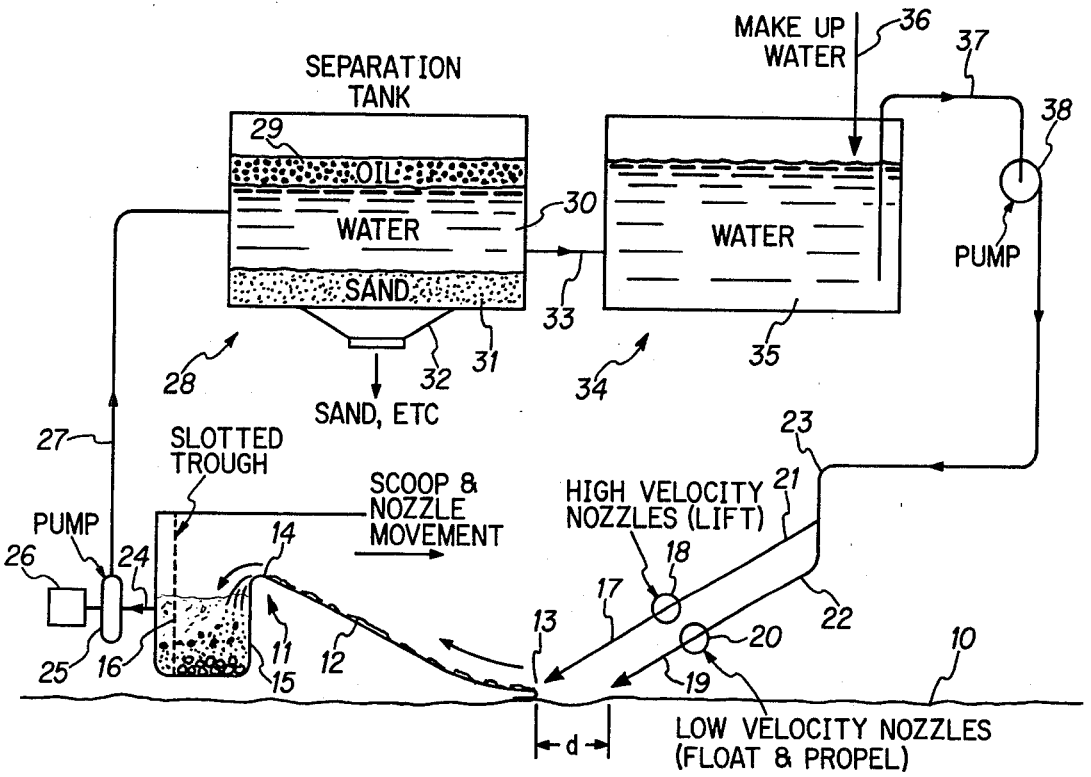
Figure 2:
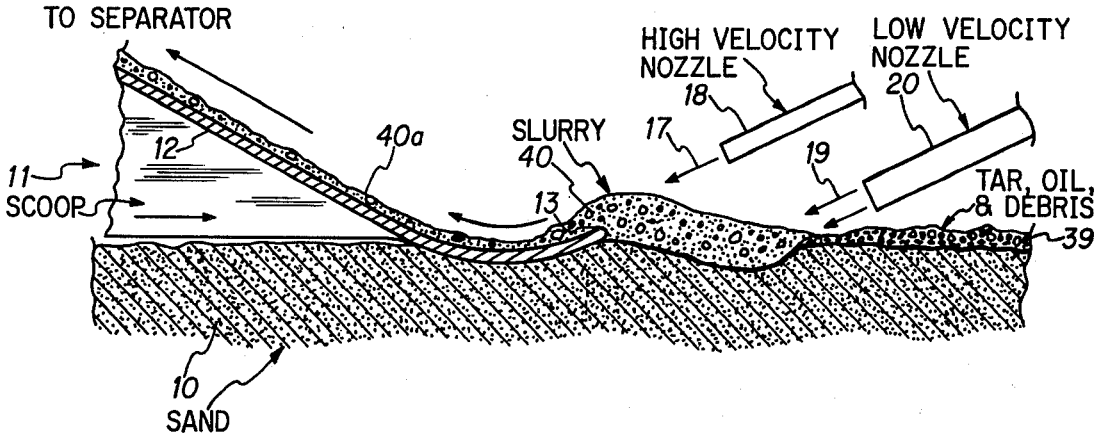
Figure 3:
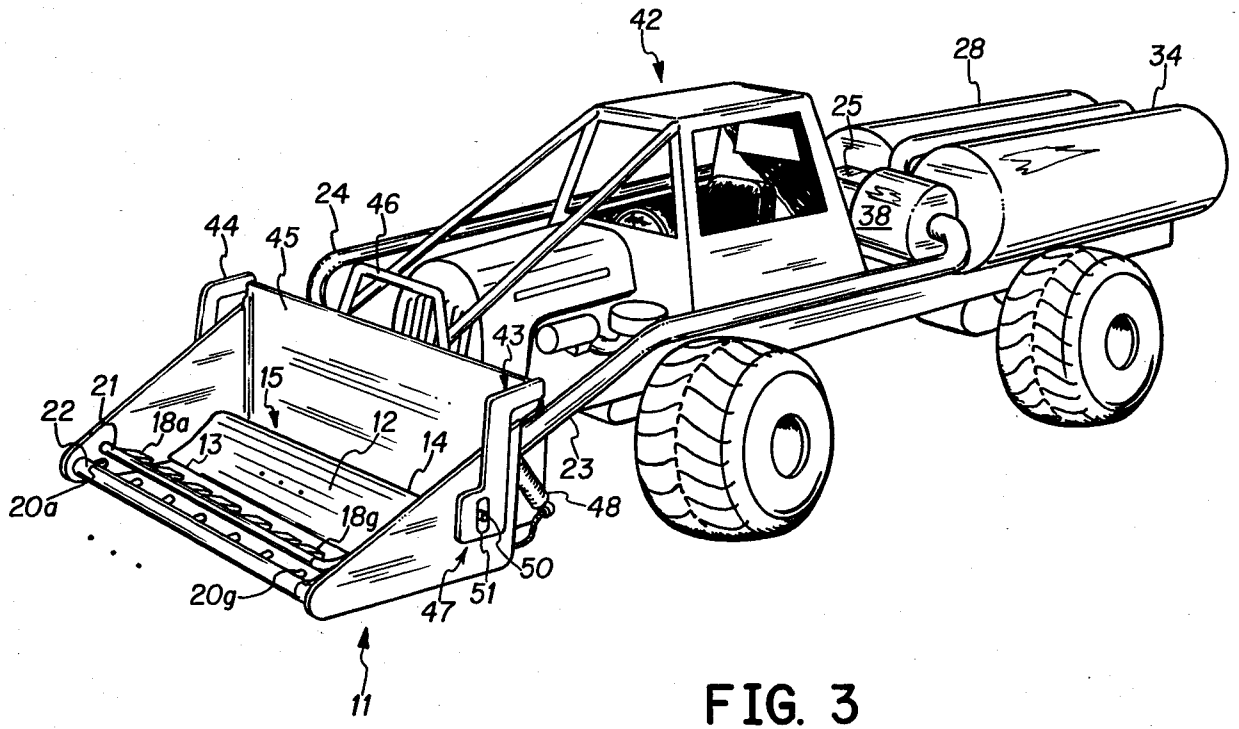

These and other features and objects of the present invention will become apparent upon reading the following description with reference to the accompanying drawings in which:

FIG. 1 represents a mechanical flow schematic of the system employed in the beach cleaning apparatus;

FIG. 2, a functional pictoral representation of the hydraulic debris lifting and propelling principles employed in the apparatus; and FIG. 3, a pictoral view of the beach cleaning apparatus as it might be mounted to, and propelled by, a prime mover vehicle for mobile, self-contained operation.

The beach cleaning apparatus to be described utilizes the principles of fluids to float debris such as oil and tar; to propel the material into a scoop; to lift the material; to separate out large objects; and to pump the oil/tar/sand/water into tanks for separation and disposal.

Water which has been through the separation process may be reused. As opposed to a mechanical handling of material, the apparatus operates hydraulically.

FIG. 1 shows a mechanical flow schematic of a "closed-loop" system depicting the operating principles of the beach cleaning apparatus. Referring to FIG. 1, the apparatus is functionally depicted in operating relationship to a surface to be cleaned, such as a beach 10. A scoop member 11 is shown in a functional side sectional view. Scoop member 11 comprises an inclined bottom plate 12, including a leading edge 13 adapted to ride on the beach surface 10. The inclined bottom plate 12 of scoop member 11 terminates in a trailing edge 14 which communicates with the upper edge of a downwardly directed trough 15, which is fitted with a screen member 16 extending vertically from the bottom of trough 15. Scoop member 11 is adapted to be moved along the beach surface in the direction indicated by the scoop movement arrow. The hydraulic process utilized to remove low density materials, such as oil, from the beach surface 10, employs two sets of nozzles. Each set of nozzles is arranged in a row extending across the scoop member in space separated positions, with the nozzle rows being substantially parallel to the scoop leading edge 13. A plurality of low velocity nozzles 20 is supplied from a pressurized supply line 22 to direct a sheet-like, low velocity water stream 19 along an impact line on beach surface 10 which extends essentially parallel to the leading edge 13 of scoop member 11 and is space displaced ahead of the scoop leading edge by a distance "d". The low velocity water stream 19 creates a "river" of length "d" which lifts and flows low-density materials into scoop member 11 while the scoop 11, as described, is moved across the beach surface 10 in a direction opposite to the "river" created by low pressure nozzles 20.

The hydraulic action imparted by the low-pressure nozzles creates a slurry of water buoyant materials, water, and surface sand which is propelled toward the mouth of the scoop member 11. This action removes a minimum amount of beach sand ($\frac{1}{8}$ inch nominally).

The lift portion of the process consists of forcing the oil/tar/sand/water mixture up the inclined bottom plate 12 of scoop 11 and over the elevated trailing edge 14 of bottom plate 12 to be received in trough 15. This lifting action is provided by high velocity jets 17 of water which emmanate from a plurality of transversely spaced separate high-velocity nozzles 18 which are supplied with pressurized water from supply line 21. The high velocity nozzles create a high energy fan-like water stream 17 which is directed to impact the scoop member 11 substantially at the leading edge 13. The high-velocity stream 17, like low-velocity stream 19, is directed at an acute angle with respect to the beach surface 10 in a direction opposite the movement of the scoop 11 along the beach surface. The slurry, created by low-velocity stream 19 directed to the scoop 11 by stream 19, is propelled by the high velocity stream 17 up the scoop bottom plate incline 12 and deposited in receiving trough 15.

Trough 15 thus receives a slurry comprised of oil, tar, beach sand and water which, as such, might be disposed of in its entirety to accomplish the basic function of the beach cleaner. However, in accordance with the present invention, a more practical and cost-efficient operation may be realized by employing recirculation of the water content of the slurry received in trough 15 in a "closed" loop system whereby the water content of the trough-received slurry is separated and reused in the aforedescribed low and high velocity water streams. For this purpose trough 15, as depicted in FIG. 1, may be fitted with a screening member such as a slatted divider member 16 which precludes passage therethrough of large debris objects while permitting water, sand, oil and smaller objects to pass through. An outlet line 24 may then communicate with the trough rear section and be connected to a pump 25, driven by motor 26, which pumps the screened slurry through pump outlet line 27 to a separation tank 28. Separation tank 28 receives the slurry. Sand 31 and other heavier-than-water substances are collected on the bottom of the separator tank where they may be periodically drained and disposed of by means of a bottom access port 32. Oil 29, collecting in the top of separation tank 28, may be skimmed off and disposed of. The water content 30 of the slurry inputted to the separation tank lies intermediate the upper oil level and bottom sand level 31, and an output line 33 may then communicate with this intermediate section to automatically drain off the water to a second supply tank 34. A water line 37 communicates with the supply of water 35 in tank 34 to provide an input supply to a high pressure pump 38. Output line 23 from high pressure pump 38 supplies pressurized water to the lines 21 and 22 which feed the respective high and low velocity nozzles 18 and 20 to complete the recirculation system. Since a small but finite quantity of water will be lost in the aforedescribed system (as primarily absorbed by the beach surface) provision is made, as indicated in FIG. 1, to add "make-up" water through line 36 inputted to the water supply tank 34.

The hydraulic method of removing the oil from the beach using hydraulic principles is pictorally represented in FIG. 2, where the hydraulic float, propel and lift principles are illustrated. Scoop 11 is depicted with scoop bottom plate 12 providing an inclined surface upwardly from the scoop leading edge 13 which rests on the surface 10 of a beach to be cleaned. Ahead of the beach surface impact point of the low velocity water stream from low-velocity nozzles 20, the surface 10 is depicted as having an over-layer 39 of tar, oil, and debris. Low-velocity water stream 19 creates a river of slurry 40 which floats the tar, oil and low density debris toward engagement with the leading edge 13 of scoop 11. High-velocity water stream 17 from high-velocity nozzles 18 impacts the slurry stream along an impact line extending substantially across scoop leading edge 13, and propels the slurry (reference numeral 40A) up the scoop incline for subsequent deposit in the aforedescribed receiving trough where a separation or disposal process may emmanate. Extensive tests under adverse weather conditions have verified that this hydraulic lifting and propelling process depicted in FIG. 2 is an excellent method for removing oil from sand, soil, concrete, or ice surfaces.

The beach cleaner herein described is suitable for mounting on trucks or special vehicles. Reference is made to FIG. 3 which shows the cleaner mounted to a commercially available Rolligon vehicle which is suitable for operation on ice and sand. FIG. 3 depicts such a vehicle 42 to which the beach cleaner is mounted. The "sweeper" portion of the system, including the scoop member 11, is shown mounted to vehicle 42 via mounting frame member 46 in a manner such that the scoop and nozzle assembly is free to self-level with respect to the surface to be cleaned. This is accomplished by slotted mounting arm members 43 which are fixed to mounting frame member 46. Pin members 50, fixed to the side walls of scoop 11, are slideably received in vertically extending slots 51 in the mounting arm members 43 to permit the scoop to rotate with respect to the mounting arm members 43 and to independently translate in the vertical with respect to the two side mounting slots. Pneumatic actuating means 48 permit an operator to raise and lower the sweeper assembly.

The pumps and tanks may be skid-mounted such that they can be easily mounted on the vehicle 42 with either a crane or forklift. FIG. 3 shows the separation tank 28 and water supply tank 34 as they might be carried on the vehicle, with high-pressure pump 38 delivering a pressurized water supply via piping line 23 to the nozzle assemblies carried on the scoop member 11. Pressurized water from line 23 communicates with branch line 22 across which are mounted high-velocity outlet nozzles **18*a*–18*g* which collectively direct a sheet-like high-velocity water stream at the leading edge 13 of the inclined scoop bottom plate 12. Supply line 23 also communicates with branch line 22 across which are mounted low-velocity outlet nozzles 20*a*–20*g* which collectively direct a sheet-like low-velocity water stream for beach surface impact ahead of the leading edge 13 of the inclined scoop bottom plate 12. Return water line 24 communicates with the trough 15 and is connected to the input port of pump 25 which may be carried on the vehicle load-bed, with the output port of pump 25 supplying return water to the water supply tank 34**.

For use on ice surfaces, it is anticipated that the system herein described would include means for heating the water supply to preclude icing during operation.

The present invention is thus seen to provide an efficient and mobile system for removing low density material from sand, soil or ice surfaces with the hydraulic operating principles being particularly effective in removing oil and tar from beach surfaces with minimum loss of beach sand and minimal depreciation of the self-contained mobile water supply employed in the process.

Although the invention has been described herein in terms of a particular embodiment thereof, it is not to be so limited in that changes might be made therein which fall within the scope of the invention as defined in the appended claims.

I claim:

1. Beach cleaning apparatus comprising; a scoop member including a bottom plate inclined upwardly from a leading edge of said bottom plate with the trailing edge of said bottom plate terminating in a downwardly disposed trough member, means for positioning said bottom plate leading edge into juxtaposition with a planar surface to be cleaned, means for directing a low-velocity water stream at a predetermined acute angle from said planar surface to be cleaned and toward said bottom plate leading edge to impact said planar surface at a predetermined impact point space-separated from said bottom plate leading edge, means for directing a high-velocity water stream at a predetermined acute angle from said planar surface to be cleaned and toward said bottom plate to an impact point substantially coincident with said bottom plate leading edge, and means for translating said scoop member in a direction opposite that toward which said water streams are directed and with respect to said surface to be cleaned.

2. The apparatus of claim 1 wherein said low and high velocity water streams emanate from nozzle means mounted in fixed relationship to said scoop member.

3. The apparatus of claim 2 wherein said scoop member has a predetermined dimension transverse to the direction in which it is propelled, with each said nozzle means comprising means to direct a sheet-like water stream extending across said predetermined transverse dimension of said scoop member.

4. The apparatus of claim 3, wherein each said nozzle means comprises a plurality of space separated nozzle orifices each communicating with a pressurized water source.

5. The apparatus of claim 3, with disposal means associated with said trough member to remove the content thereof.

6. The apparatus of claim 5, wherein said disposal means comprises outlet port means communicating with said trough member, a screening member affixed within said trough member through which predetermined trough contents are passed to said outlet port means, and means connected to said outlet port to receive the screened trough member contents.

7. The apparatus of claim 6, wherein said outlet port is inputted to a pump means through which the screened content of said trough member is pumped to a separation container, outlet means communicating with the water content of said separation container, and further pump means disposed between said separation container outlet means and said nozzle means to supply pressurized water to said nozzle means.

8. The apparatus of claim 7, further including a make-up water container means interposed between the water outlet of said separation container and the input of said further pump means, whereby the water content of said make-up water container means is recirculated through said nozzle means.

9. The apparatus of claim 8, wherein said trough member is provided with disposal access means from which that portion of the trough content which is precluded from passing through said screening member may be disposed.

* * * * *